US009212866B1

(12) United States Patent
Hakl

(10) Patent No.: US 9,212,866 B1
(45) Date of Patent: Dec. 15, 2015

(54) OPTICAL DIFFRACTION ALIGNMENT LENS

(71) Applicant: Anthony R. Hakl, Loda, IL (US)

(72) Inventor: Anthony R. Hakl, Loda, IL (US)

( * ) Notice: Subject to any disclaimer, the term of this patent is extended or adjusted under 35 U.S.C. 154(b) by 0 days.

(21) Appl. No.: 14/532,042

(22) Filed: Nov. 4, 2014

Related U.S. Application Data

(60) Provisional application No. 61/901,040, filed on Nov. 7, 2013.

(51) Int. Cl.
*F41G 1/467* (2006.01)
*F41G 1/08* (2006.01)
*F41B 5/14* (2006.01)

(52) U.S. Cl.
CPC ..... *F41G 1/08* (2013.01); *F41B 5/1419* (2013.01); *F41G 1/467* (2013.01)

(58) Field of Classification Search
CPC ..... F41G 1/467
USPC ..... 33/265; 124/87
See application file for complete search history.

(56) References Cited

U.S. PATENT DOCUMENTS 3,703,771 A * 11/1972 Saunders ..... 33/265
4,454,857 A * 6/1984 Miller et al. ..... 124/87
4,833,786 A * 5/1989 Shores, Sr. ..... 33/265
5,148,603 A 9/1992 Beutler
5,325,598 A * 7/1994 Hall et al. ..... 33/265
5,347,976 A * 9/1994 Saunders ..... 124/87
5,542,186 A * 8/1996 Saunders ..... 33/265
5,669,146 A * 9/1997 Beutler ..... 33/265
5,671,724 A * 9/1997 Priebe ..... 124/87
6,131,295 A 10/2000 Cranston
6,282,800 B1 9/2001 Beutler
6,628,464 B1 * 9/2003 Johnson ..... 359/894
6,981,329 B1 1/2006 Strathman
7,040,027 B1 * 5/2006 Shaffer et al. ..... 33/265
7,373,723 B1 5/2008 Tupper, Jr.
7,543,389 B2 6/2009 Grace, Jr.

* cited by examiner

*Primary Examiner* — Christopher Fulton

(57) ABSTRACT

The invention is an Optical Diffraction Alignment Lens, incorporating a symmetric planar-array of pin-hole apertures, installed in a split bowstring configuration replacing the conventional peep sight on a tuned compound bow with a front sight fiber optic pin, providing to the archer a virtual aperture through the fiber optic pin tip as a precise alignment and aiming system for the arrow flight path to target. The Optical Diffraction Alignment Lens, the center of which is positioned in the vertical plane centered on the arrow flight path and fixed relative to the arrow nock end, presents to the aiming eye of the archer, a well-defined virtual aperture image in the tip of the front fiber optic pin, as a centered point of alignment, that is centered by the archer in the line-of-sight which the archer aligns through the virtual aperture to the impact point on target.

16 Claims, 5 Drawing Sheets

OPTICAL DIFFRACTION ALIGNMENT LENS

CROSS-REFERENCE TO RELATED APPLICATION

This application claims the benefit of U.S. Provisional Application Ser. No. 61/901,040, Nov. 7, 2013.

FIELD OF THE INVENTION

This invention relates to the sport of archery. More particularly, this invention relates to archery bows and sights.

BACKGROUND OF THE INVENTION

1. The Bow and Arrow

The bow and arrow were first used in prehistoric times for hunting and warfare. Firearms have long since replaced the bow and arrow for warfare and for most types of hunting. However, the bow and arrow continue to be used for target shooting and for some types of hunting. The sport of shooting with a bow and arrow is known as archery.

As shown in FIG. 1, a bow 10 is a curved and elongated piece of a flexible material such as wood, fiberglass, carbon fiber, or the like. The upper portion 11 and lower portion 12 of the bow are referred to as limbs. The middle portion 13 containing the grip 14 and the arrow rest 15 is referred to as a riser. A bow string 16 extends between the ends of each limb. The bow is used by holding the grip with one hand, placing the nock (notched end) of an arrow 17 onto the bow string at the nocking point, pulling the bow string back to the fully drawn position near the cheek, aligning the arrow, aiming the arrow, and then releasing the bow string. The arrow is propelled by the bowstring as the bow snaps back toward its rest position. The bow shown is of the modern compound type having a levering system of cables and cam pulleys. Older types of bows, including the recurve bow and the long bow, continue to be used.

2. Sights

Ancient archers aimed by sighting down the length of the shaft of the drawn arrow. Referring to FIG. 1, most modern archers use a bow sight 18 mounted on the riser of the bow. A variety of bow sights have been disclosed for mounting to the riser of the bow. These bow sights are sometimes referred to as front sights. As used herein, "front" refers to a side facing the target and "rear" refers to a side facing the archer. Sides designated "right" and "left" are also from the point of view of the target rather than from the archer. Front sights typically include single or multiple fiber optic pins, filaments, or other aiming points with each specific point selected corresponding to a specific distance between the archer and the target.

Archers in all forms of hunting and target shooting competition today, involving the use of a compound bow with a front sight fiber optic point, predominantly use a second, rear sight 19 on their bows. As illustrated in FIG. 2, the most common rear sight is a metal or plastic disk having a single circular aperture that is inserted into the bow string at the position on the bowstring determined through proper tuning of the bow. The rear sight contains notches, grooves, channels, or other indentations on its outer surface which engage separated strands of the bow string. As determined by the bowstring angle when at full draw of the arrow, the notches are angled so that the central aperture axis is horizontal for aiming. The archer aims by looking through the single circular aperture, blurred by proximity focus constraints of the eye, in the rear sight disk, visually estimating that the line of sight from the aiming eye of the archer to the intended impact point of the arrow on target is centered in that aperture, and centering the front sight fiber optic pin on the intended arrow impact point on target. The broken line in FIG. 2 represents the line of sight of the archer. The second sight is sometimes referred to as a peep sight. The diameter of the aperture in a peep sight varies from about 0.05 to 0.25 inches. As the diameter decreases, the field of view through the aperture is proportionately reduced. As the diameter increases, the perceived visual acuity presented to the aiming eye of the archer, which is key for alignment and aiming, decreases.

Recent advances during the past decade in the increased intensity of light produced from the front sight fiber optic pin has allowed the use of rear sights in all types of hunting and competitive shooting with compound bows employing front sight fiber optic pins. A variety of rear sights have been disclosed. Nearly all of these prior art rear sights incorporate the basic design principle of a single circular aperture.

Cranston, U.S. Pat. No. 6,131,295, Oct. 17, 2000, discloses a rear sight having two optical fibers that suggest their use to illuminate a space between their ends. The archer uses the illuminated space as the aiming guide. In this application, it is important to recognize that the optical transmission of light along the central axis of a fiber optic is exceptional and supports the wide application of fiber optic cables for the transmission of light along the central axis of the fiber. For illumination purposes, the predominant use of light provided by a fiber optic is that light emitted from the end of the fiber optic which typically is of a relative high intensity. The light, the patent suggests provides illumination, is that light emitted orthogonal to the central axis of a fiber optic, which is light leakage through the encapsulating membrane of the optic fibers and thereby, as a source of illumination, it would be negligible. In a side-by-side comparison, the visual perception of the illumination by light leakage orthogonal to the central axis of a fiber optic would be equivalent to the illumination by the reflected light from a brightly colored plastic thread.

Beutler, U.S. Pat. No. 6,282,800, Sep. 4, 2001, discloses a rear sight having a centrally located sighting aperture. A plurality of other apertures is located around the central aperture to provide additional light by increasing the effective field of view. Tupper, Jr., U.S. Pat. No. 7,373,723, May 20, 2008, discloses a rear sight having an annular optical fibers, which only would provide some small level of illumination though light leakage orthogonal to the central axis of the fiber optic, around the sighting aperture. Grace, Jr., U.S. Pat. No. 7,543,389, Jun. 9, 2009, discloses a rear sight having a sighting aperture with a curvilinear bulge.

Rear sights with allegedly transparent cross members have also been disclosed.

Beutler, U.S. Pat. No. 5,148,603, Sep. 22, 1992, discloses an illuminated rear peep sight, one embodiment of which has transparent cross hairs. Strathman, U.S. Pat. No. 6,981,329, Jan. 3, 2006, discloses a rear peep sight with transparent fiber optic cross hairs. While these rear sights with additional lighting or transparent cross hairs are helpful in low light situations, they do not improve the accuracy in competitive target shooting where low light is not a concern. Throughout the past decade in the sport of archery, based on the significant technical advances in fiber optics as light sources, along with battery powered lights integral to the front sight fiber optic pin types of front sight on compound bows, there would be an accepted consensus, that low light levels in the sport of archery, are of negligible concern.

3. Alignment and Aiming

Both alignment and aiming of the arrow are key to accuracy in the shooting of an arrow from a bow in the sport of archery. Alignment is achieved when the line-of-sight of the archer lies in the same vertical plane above both the shaft of the arrow and the flight path of the arrow. Aiming is achieved by the line-of-sight of the archer ending on the target impact point. Precise and accurate visual indicators verifying alignment and aiming, presented to the eye of the archer when ready to fire an arrow at a target, do not exist in current archery equipment. Indicators used are mostly based on visual estimation or are blurred and not clearly discernible.

A front point and rear point for alignment and aiming of the arrow are important for accurate shooting in archery. The line-of-sight, for the archer in alignment and aiming, is established by the archer centering his eye in the line-of-sight from the centered front point of alignment on the front sight mounted on the compound bow through the centered rear point of alignment on the bow. When the arrow is at full draw position, this line-of-sight is then centered by the archer on the intended impact point on target. While maintaining this position and line-of-sight alignment with a properly tuned bow, upon release of the arrow from the compound bow the flight path of the arrow will intersect the line-of-sight of the archer at the intended impact point on target.

In the recent practice of the sport of archery, a fiber optic pin is installed in a front sight mounted on the riser of a compound bow. In tuning the compound bow, the tip of the fiber optic pin is adjusted to be the centered point of alignment in the front sight mounted on the compound bow. For shooting at targets at multiple distances from the archer, multiple fiber optic pins in the front sight placed at different heights above the arrow point create aiming points that each correspond to a different distance between the archer and the intended impact point on the target In the current sport of archery utilizing a compound bow, a single open aperture peep sight is often installed in a split bowstring configuration on a bow. With an arrow at full draw, the single open aperture peep site does not present to the eye of the archer a centered point of alignment in a fixed position relative to the nock end of an arrow. Lacking a visible center point in the rear peep sight, with each shot of an arrow from the compound bow with a single open aperture rear peep sight, the archer must visually estimate the precise visual location of the actual precise optical center of the single aperture in order achieve centering of the aperture of the rear peep sight relative to the true center of the line-of-sight from the tip of the fiber optic pin in the front sight. The uncertainty in the precise centering of the rear sight in the line-of-sight proportionately increases the uncertainty in hitting the intended impact point on target. For example, in shooting at a target at 30 yards, an off-center alignment estimate of 0.050 inch in centering the rear sight results in a 1.800-inch off-center impact on target.

Extensive practice and training with techniques such as a repeatable position for an anchor point and kisser buttons can assist in approximate line-of-sight centered positioning of the single open aperture rear peep sight. With these body configuration techniques there is no optical, well-defined, visual indication presented to the eye of the archer that verifies centered line-of-sight alignment on the intended target point.

4. Optical Diffraction Alignment Lens

Most prior art on bowstring mounted devices for archery applications, includes the single circular aperture peep sight. The basic concept of the single circular aperture peep sight was developed to respond to early military needs. The function of the single aperture peep sight met with limited success in archery applications.

The single aperture peep sight has been the dominant device and technique in modern archery to date. To achieve an estimated degree of alignment of the flight path of the arrow with the line of sight of the archer to the intended on-target impact point, concentric circle alignment was the technique employed. The rear sight employed a single circular aperture. The front sight fiber optic pin was centered in a circular ring forming the frame of the front sight. The targets in competitive archery shooting employed a concentric group of circles as shown in FIG. 3.

To align the shot of an arrow on the intended target impact point, the single circular aperture of the rear peep sight (i.e. circle 1) was made concentric with the 2-inch diameter circular frame (i.e. circle 2) of the front sight which was visually aligned, through the aiming eye of the archer when at full-draw of the arrow, to be made concentric with the circular ring (i.e. circle 3) on the target while visually estimating with the aiming eye of the archer that the tip of the fiber optic pin in the front sight was centered in the blurred (due to proximity focus) outline of the rear peep sight circular aperture (i.e. circle 3). With this approach to concentric alignment of these three circles, the exact impact point (within circle 3) on target was occluded by the tip of the fiber optic pin in the front sight (circle 2) thereby occluding from the aiming eye of the archer the precise center of circle 3. Similarly, with each shot of an arrow, there would be a varying degree in the uncertainty of visually centering (in circle 1) the tip (in circle 2) of the front sight fiber optic pin in the center of the blurred image, presented to the aiming eye of the archer at full-draw of the arrow, of the outline (circle 1) of the rear peep sight circular aperture. This cumulative amount of center point location uncertainty within all of the three circles, makes the concentric circle alignment technique, an adequate but imprecise approach for precise target impact point results.

In both outdoor 3-D archery competition and animal hunting, there are no concentric rings on the target. This removes the arrow shot alignment option utilizing the three circle concentric alignment.

In the sport of competitive archery, for one type of competition, the perfect competitive indoor round shot at 20-yard distance, requires placing thirty-out-of-thirty arrows shot at a target, within the 1.5-inch diameter "X" area of the 3-inch diameter "10" area on a target as illustrated in FIG. 3.

Two factors continue to impede both near perfect scores in competitive archery and reliable tight arrow shot groupings in hunting. The first factor is the exact target impact point is occluded by the tip of the front sight fiber optic pin as illustrated by the shaded circular area in FIG. 4. The second factor was a clearly visible verification of the exact center of the aperture (i.e. the above described circle 1) in the single aperture peep sight was elusive if not lacking. The challenge was to design a bowstring-mounted device that would remove the occlusion of the front sight fiber optic pin (i.e. form a virtual aperture through the center of the tip of the front sight fiber optic pin) and at the same time, present to the aiming eye of the archer an optical verification of the alignment of the flight path of the arrow to ensure it would impact the intended on-target point. There is no prior art in a bowstring mounted rear peep sight that could achieve either of these objectives. The fundamental single aperture peep sight design needed to be abandoned.

The Optical Diffraction Alignment Lens replaces the bowstring-mounted peep sight. The definition of a peep sight is generally accepted to contain a single circular aperture. The Optical Diffraction Alignment Lens is not designed to be a single aperture bowstring mounted peep sight. The Optical Diffraction Alignment Lens cannot function as a single aperture bowstring mounted peep sight since it lacks the single circular aperture in which the archer aligns the front sight or target.

The Optical Diffraction Alignment Lens is not a single circular aperture peep sight but is a lens incorporating a symmetric planar-array of multiple pin-hole apertures. The key design factor in the Optical Diffraction Alignment Lens is the symmetric planar-array of multiple pin-hole apertures which optically form a virtual aperture (the unshaded plus-sign area in the center of FIG. 5) in the center of the front sight fiber optic pin and at the same time presents to the aiming eye of the archer an optical verification, the centering of the virtual aperture in the line of sight of the archer, of the alignment of the flight path of the arrow to ensure it would impact the intended on-target impact point.

The Optical Diffraction Alignment Lens does not contain a single circular aperture and does not utilize concentric circle alignment with the circular frame of the front sight fiber optic pin.

Most prior art for archery applications, on bowstring mounted devices, include the single circular aperture peep sight. Preliminary patent searches and the review of numerous patent applications have not identified any prior art on the optical formation of virtual apertures in archery bowstring mounted devices. Similarly there is no prior art on symmetric planar-array of multiple pin-hole apertures for archery applications.

The Optical Diffraction Alignment Lens is an optical device to image, in the optical construct of a virtual aperture, the light from the front sight fiber optic pin and use that image (i.e. virtual aperture) to determine the precise horizontal and vertical alignment of the line of sight from the aiming eye of the archer to the targeted impact point, relative to the flight path of the arrow which on a properly tuned compound bow with a front sight fiber optic pin, will impact the target at the point of intersection of the line of sight of the archer with the flight path of the arrow.

The Optical Diffraction Alignment Lens is an optical device to image, in the optical construct of a virtual aperture, the light from the front sight fiber optic pin and use that image (i.e. virtual aperture) to determine the precise horizontal and vertical alignment of the line of sight from the aiming eye of the archer to the on target impact point, relative to the flight path of the arrow which on a properly tuned compound bow with a front sight fiber optic pin, will impact the target at the point of intersection of the line of sight of the archer with the flight path of the arrow.

An ongoing issue with single aperture peep sights is the diameter of the aperture. A large aperture offers the advantages of increased field of view for hunting applications along with more light gathering capability, and the disadvantages of difficulty in centering the front sight fiber optic pin for alignment and aiming. A small diameter aperture reduces the field of view and reduces light gathering capability while improving ease of optically centering the front sight fiber optic pin for alignment and aiming. The Optical Diffraction Alignment Lens, with a symmetric planar-array of pin-hole apertures, eliminates the presence of single aperture issues.

Further, by design and construction, the four (4)-aperture array within the Optical Diffraction Alignment Lens also functions as a four (4)-aperture pin-hole lens thereby achieving the level of corrective lens imaging often achieved by use of a clarifier lens. Similarly, by design and construction, the four (4)-aperture array within the Optical Diffraction Alignment Lens also functions as a four (4)-aperture pin-hole lens thereby achieving a level of increased visual acuity or optical resolution often achieved through the use of a front-sight magnifying-lens.

When installed in a split bowstring configuration on a properly tuned compound bow with a front sight fiber optic pin, the Optical Diffraction Alignment Lens embodying a centered planar array of pin-hole lenses, forms a virtual aperture, through both the center of the Optical Diffraction Alignment Lens and the center of the tip of the front sight fiber optic pin, thereby visually presenting to the aiming eye of the archer, when at full draw of the arrow that is properly aligned and aimed at the intended target point, both an unobstructed view centered on the archer's line of sight to the intended arrow impact point on target, and a clear optical indication, to the aiming eye of the archer, of both the horizontal alignment and vertical alignment of the flight path of the arrow necessary to cause the arrow to impact the target at the intended on-target aim point of the archer.

There is no other prior art for an optical device, installed in a split bowstring configuration on a compound bow with a front sight fiber optic pin, that forms an unobstructed virtual aperture as indicated above.

There is no other prior art for an optical device, installed in a split bowstring configuration on a compound bow with a front sight fiber optic pin, that forms a clear optical indication of the alignment of the flight path of the arrow as indicated above.

SUMMARY OF THE INVENTION

The general objects of this invention are to provide an Optical Diffraction Alignment Lens for split bowstring installation on a compound archery bow with a front sight fiber optic pin, an improved archery bow and sight alignment assembly, and an improved method of optical verification of the alignment of the flight path of the arrow shot from the bow with the line of sight of the archer when aimed on target.

I have invented an Optical Diffraction Alignment Lens for split bowstring installation on a compound archery bow with a front sight fiber optic pin. The lens comprises a disk with a front face, a rear face, a side with opposing indentations for attachment to the bowstring strands, and a centered symmetric array of three or more pin-hole aperture lenses with the apertures extending through the disk perpendicular to the face of the disk.

The preferred embodiment of the Optical Diffraction Alignment Lens with four (4) pin-hole apertures has orthogonal circular symmetry and presents to the aiming eye of the archer when at full draw of the arrow a virtual aperture with visually perceived right-left and up-down movement to achieve and verify alignment of the on-target line of sight of the archer with the on-target flight path of the arrow.

The number and spacing of the centered symmetric array of pinhole apertures could be ten (10) or more in number but fabrication constraints and cost consideration would be generally unjustified.

The centered symmetric planar array of pin-hole apertures eliminates the prior art single-aperture centering limitations.

The centered symmetric planar array of pin-hole apertures eliminates the prior art single small-aperture light gathering limitations.

The Optical Diffraction Alignment Lens forms a precisely centered transparent aperture spot with radial extensions, the number, and width of these radial extensions being determined by the number and interstitial spacing of the individual pin-hole apertures. These radial extensions are an aid in visually determining the initial non-alignment situation.

The performance of the Optical Diffraction Alignment Lens has been repeatedly verified optically with both photographs and video documentation.

In nearly all prior art absent a visually clear, fixed-point-of-alignment relative to both the nock-end of the arrow, and in the vertical plane above the center of the arrow, three (3) circle alignment is the alignment mechanism.

The Optical Diffraction Alignment Lens does provide a clear fixed point of alignment both relative to the nock end of the arrow, and in the vertical plane above the center of the arrow. With the use of the Optical Diffraction Alignment Lens, there is neither need for nor utilization of:

- the circle of the rear single aperture peep sight
- the circular frame of the typical front sight mounted on the riser of the bow
- the circles on the target in some forms of competitive archery.

In addition, with not being required to employ a three concentric circle alignment approach, the Optical Diffraction Alignment Lens provides the competitive archer in 3-D targeting a significant advantage.

In an effort to identify prior art, a preliminary patent search was funded. An effort was also conducted to search a significant number of individual patents. The results of these efforts indicated that there is no prior art specific to the optical formation of virtual apertures in archery bowstring mounted devices. Similarly there is no prior art specific to symmetric planar array pin-hole lenses for archery applications.

The Optical Diffraction Alignment Lens eliminates the need for the commonly used single aperture rear peep sight. Since the Optical Diffraction Alignment Lens does not meet by its intended design, function, and utility, the generally accepted single aperture definition of a peep sight, the Optical Diffraction Alignment Lens is discussed as a specific type of optical lens in its design, function, and utility.

I have also invented an improved archery bow and sight alignment assembly. The assembly comprises: (a) a bow having an upper limb with an end, a lower limb with an end, and a riser with a grip and an arrow rest, the bow having a fully drawn position and a rest position; (b) a bow string extending between the ends of the bow; (c) a front sight mounted on the riser of the bow; and (d) an Optical Diffraction Alignment Lens attached to the bowstring, of a compound bow with a front sight fiber optic pin, in a split bowstring configuration with the exact position on the bowstring determined through proper tuning of the bow.

I have also invented an improved method for aiming an arrow shot from a bow to a precise point on a target. The method comprises: (a) providing a compound bow and arrow alignment assembly comprising: (i) a compound bow having an upper limb with an end, a lower limb with an end, and a riser with a grip and an arrow rest, the bow having a fully drawn position and a rest position; (ii) a bow string extending between the ends of the bow; (iii) a front sight, with a fiber optic pin, mounted on the riser of the bow; and (iv) an Optical Diffraction Alignment Lens attached to the bowstring, of a compound bow with a front sight fiber optic pin, in a split bowstring configuration with the exact position on the bowstring determined through proper tuning of the bow, the lens comprising a disk with a front face, a rear face, the circular perimeter side of the disc with opposing indentations for attachment to bowstring strands, and a centered symmetric array of three or more pin-hole aperture lenses with the apertures extending through the disk perpendicular to the face of the disk; (b) providing an arrow having a shaft and a nock; (c) placing the nock of the arrow onto the bow string and resting the shaft of the arrow upon the arrow rest; (d) drawing the bow; and (e) aligning the arrow with the lens, the front sight, and the target to aim, the arrow shot from the bow, at the selected target point.

The level of precision provided by the Optical Diffraction Alignment Lens in arrow alignment translates into an exact on target impact to within +/−0.1 inch of aim-point at release. No other arrow alignment and aiming device for compound bow archery application achieves the Optical Diffraction Alignment Lens level of alignment and aim precision.

DETAILED DESCRIPTION OF THE INVENTION

1. Overview

Figure 1:
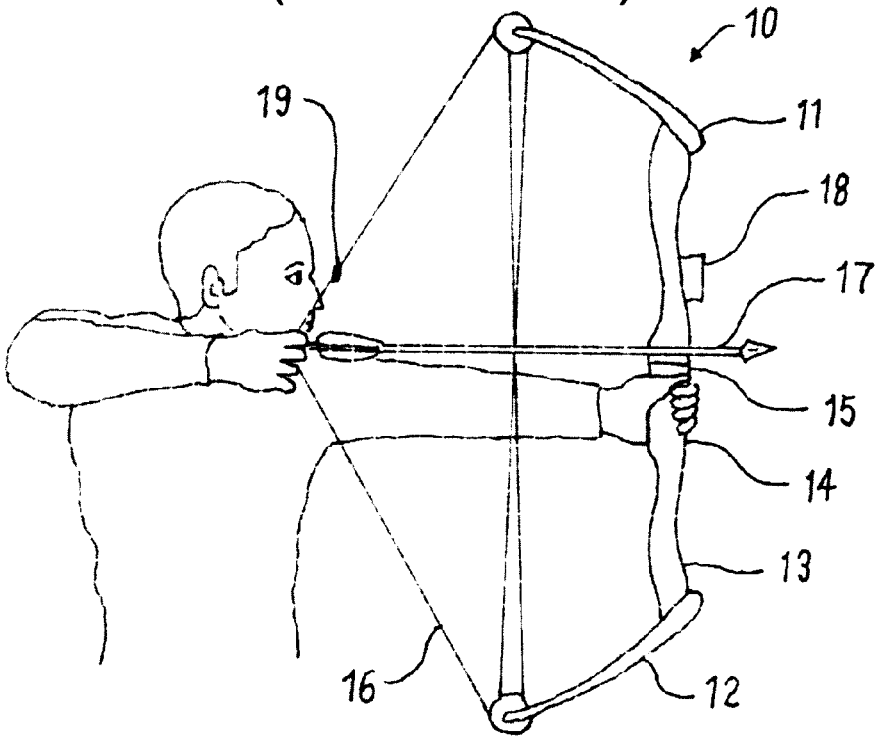
FIG. 1 (PRIOR ART)
FIG. 1 is an elevation view of an archer aiming a bow having a front sight and a rear sight mounted on the bow string.
Figure 2:
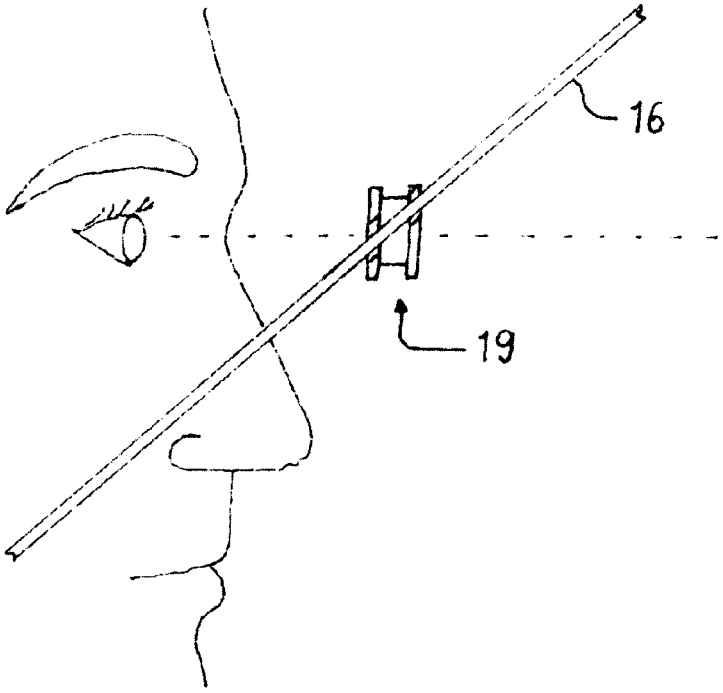
FIG. 2 (PRIOR ART)
FIG. 2 is a detailed elevation view of an archer aiming with a rear sight.
Figure 3:
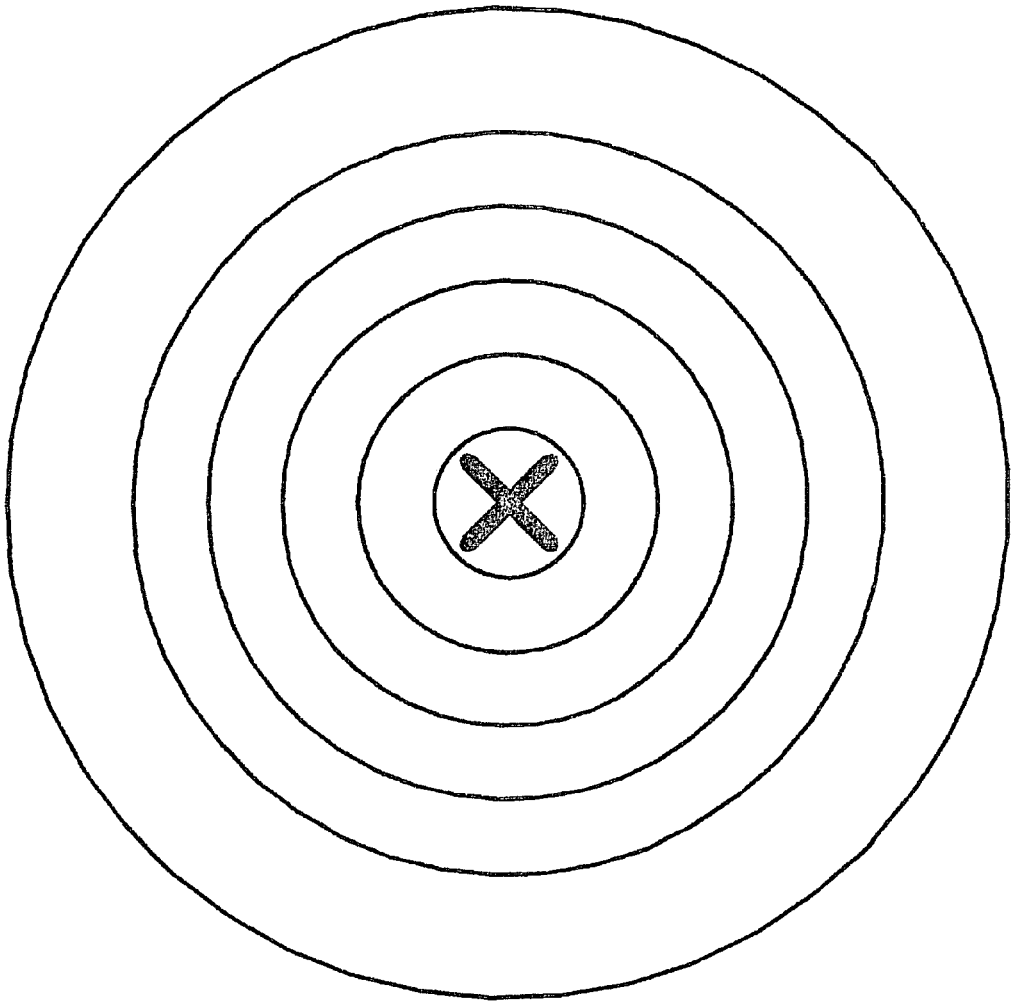
FIG. 3 (PRIOR ART)
FIG. 3 is an illustration of a typical archery target layout with concentric circles and innermost ring X designation.
Figure 4:
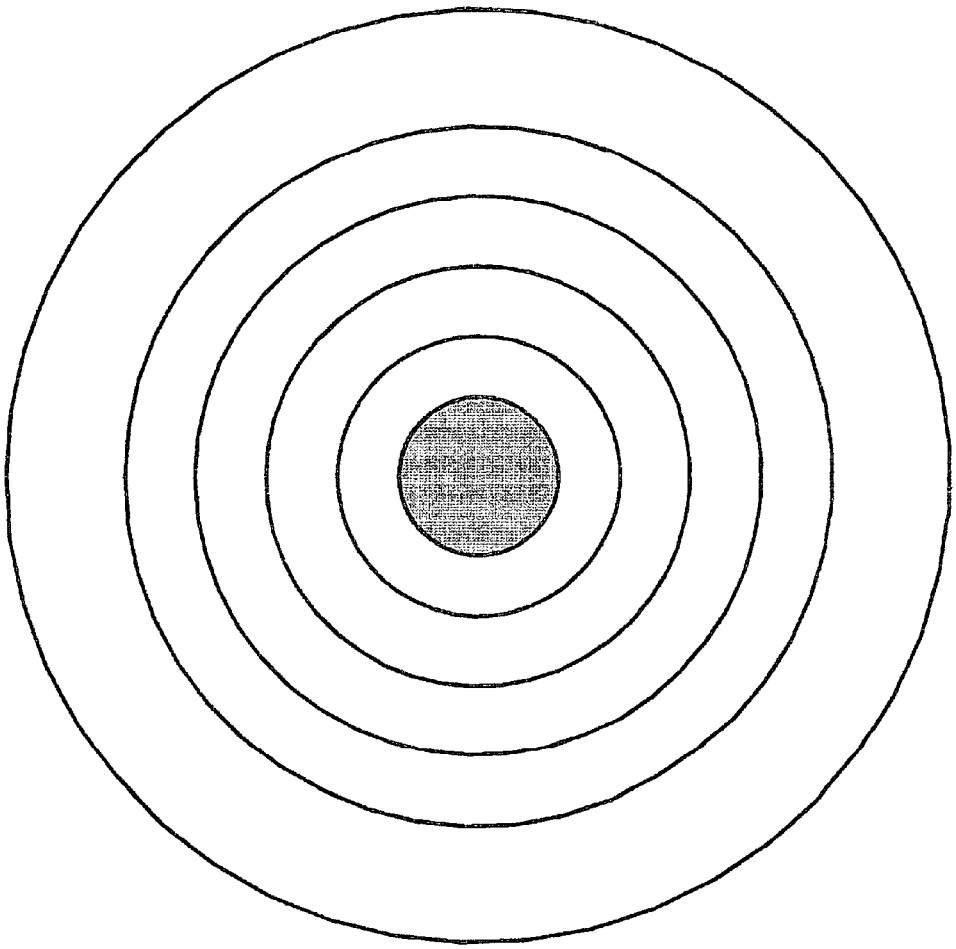
FIG. 4 (PRIOR ART)
FIG. 4 is an illustration of occlusion of on-target impact point by the opacity of the front site fiber optic pin when aligned on the intended target impact point.

This invention is best understood by reference to the drawings. Referring to FIGS. 6 to 9, the Optical Diffraction Alignment Lens 20 of this invention is a disk with a front face 30, a rear face 40, a side 50 with opposing indentations 60 for attachment to bow string strands, and a plurality of apertures 70 extending between the apertures. The planes formed by the front face and the rear face are generally parallel. The apertures are generally perpendicular to the faces. The side indentations are machined on the circular edge of the disk cylinder of the Optical Diffraction Alignment Lens to position and anchor the flat edge of the cylinder such that the top of the Optical Diffraction Alignment Lens is orthogonal to the line-of-sight from the eye of the archer to the intended target, when in a full-draw of the arrow position. The specific installation of the Optical Diffraction Alignment Lens can require two (2) or four (4) notches depending on the preferred installation chosen by the archer. The specific design and dimensions of the bow will determine the angle of the notches which will range from more than thirty (30) degrees to less than fifty (50) degrees.

2. Structure

The Optical Diffraction Alignment Lens is installed in a split bowstring configuration on a compound bow with a front sight fiber optic pin and thereby eliminates the need for the use of the single open aperture rear peep sight. The Optical Diffraction Alignment Lens is initially constructed as a right circular cylinder with a thickness adequate to maintain the structural integrity of the cylinder with use in the intended fashion. The lens is generally a disk with diameter of about 0.3 to 0.7 inches, preferably about 0.5 inch, and with a thickness of about 0.1 to 0.25 inches, preferably about 0.125 inches.

The lens contains a centered symmetric array of three (3) or more pin-hole apertures. The size of the pin-hole aperture is determined by the requirements of an aperture to function as a pin-hole lens, which is estimated as a maximum aperture diameter of 0.15 inch or less. The specific shape of the pin-hole aperture perimeter is that of a closed curvilinear pattern that maintains any cross section diameter of the aperture within the optical limits necessary to function as a pin-hole lens. The aperture interstitial spacing has a width of about 0.010 to 0.060 inch, preferably about 0.02 inches. The optimal specific width is based on the visual acuity of the archer and the selected detail desired to be imaged by the archer. The apertures have mirror symmetry around the major axis of the cylinder.

The Optical Diffraction Alignment Lens is installed in a split bowstring configuration on a compound bow with a front sight fiber optic pin. The split bowstring installation of the Optical Diffraction Alignment Lens is consistent with well-known and understood practice in the field of archery utilizing a compound bow with a front sight fiber optic pin installed on the handle of the bow The tuning of the compound bow having a split bowstring installation of the Optical Diffraction Alignment Lens is consistent with well-known and understood practice in the field of archery utilizing a compound bow with a fiber optic pin front sight installed on the handle of the bow.

The material used to fabricate the Optical Diffraction Alignment Lens has adequate mechanical properties to be mounted in a split bowstring configuration and withstand the forces imposed by the bowstring in shooting an arrow. The Optical Diffraction Alignment Lens of this invention is preferably made of a hard, durable material. Metals such as aluminum and magnesium are preferred for durability. Certain plastics with adequate structural properties are also suitable.

Depending on material and aperture size selection, the fabrication of the four individual apertures requires a sequence of fabrication operations. Initial attempts with 3D photolithography could not maintain the requisite tolerances of the preferred embodiment of the Optical Diffraction Alignment Lens. In addition, the structural impact loadings, when shooting an arrow with a compound bow, had caused earlier plastic bowstring mounted devices to rapidly fail. The specific preferred embodiment required the development of CAD drawings, prototype fabrications, and was performed on a multi-axis numerical milling machine.

After reducing the diagonal interstitial space between the four adjoining corners, the orthogonal structure of the central portion of the Optical Diffraction Alignment Lens takes on the appearance of a plus sign with arms approximately 0.01 to 0.06 inch in thickness. The arms of the orthogonal structure are then further machined to achieve the desired surface finish while maintaining a disk thickness in the arms of more than double the interstitial spacing of the apertures.

The overall size of the Optical Diffraction Alignment Lens preferably fits within a nominal 0.5-inch diameter disk. Modern hunting and competitive archery using rear alignment devices lacking a visible center point for alignment inclined the archer to try to use the smallest aperture possible for ease in estimating concentric alignment of rear sight with front sight. The Optical Diffraction Alignment Lens does have a visible center point for alignment, which thereby allows the archer to select the largest optical field of view desired. Typical fields of view range from about 0.0625 to 0.250 inches in diameter. The aperture array design of the Optical Diffraction Alignment Lens increases the effective aperture diameter orthogonal to the line-of-sight through the center of the Optical Diffraction Alignment Lens, thereby creating a wide field of view through the center of the Optical Diffraction Alignment Lens. This effective large diameter aperture achievement is without the accuracy degradation occurring in peep sights with a large diameter single aperture.

For shooting with a compound bow up to 80 pound draw weight, the mechanical and structural loads imposed on the small dimension portions of the Optical Diffraction Alignment Lens may impose the need for a single integral piece metal structure for the Optical Diffraction Alignment Lens. Numerical controlled milling and fabrication machines can readily fabricate the Optical Diffraction Alignment Lens in an integral manner from a single piece of material.

The line-of-sight for using the Optical Diffraction Alignment Lens when installed in a compound bow, is from the eye of the archer through the center virtual aperture of the Optical Diffraction Alignment Lens, through the virtual aperture in the center of the centered alignment tip of the fiber optic pin in the front sight installed on the bow, and to the intended impact point on the target. With a properly tuned compound bow not requiring adjustments for windage impacts on the flight path of the arrow, the flight path of the arrow is centered in the same vertical plane of the line-of-sight established by the alignment and aiming of the compound bow with the arrow at full draw position with the Optical Diffraction Alignment Lens.

Figure 5:
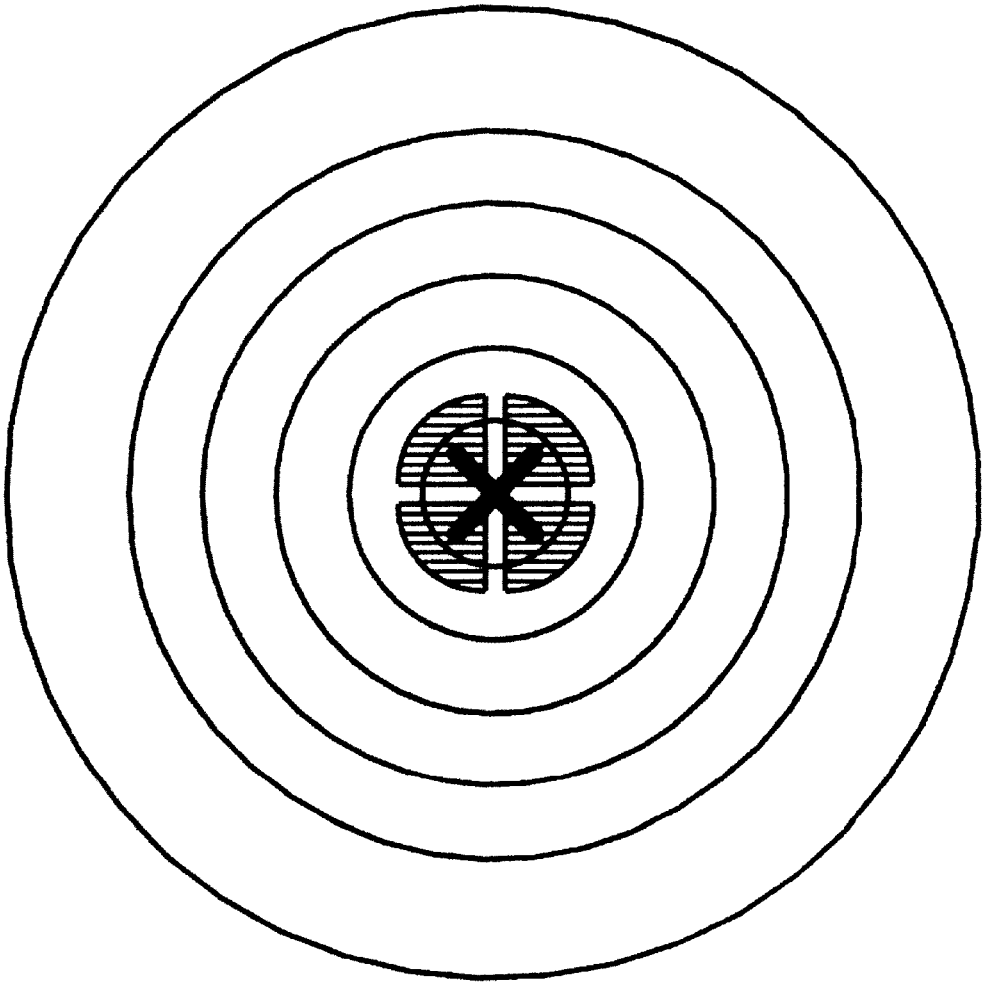
FIG. 5 is an illustration of the orthogonal, plus-sign shaped, virtual aperture, formed by the Optical Diffraction Alignment Lens containing four (4) apertures, presented to the eye of the archer at full draw of the arrow with a compound bow equipped with a front sight fiber optic pin, when the line of sight to the on-target impact point is aligned with the flight path of the arrow to the on target impact point of the arrow.
Figure 6:
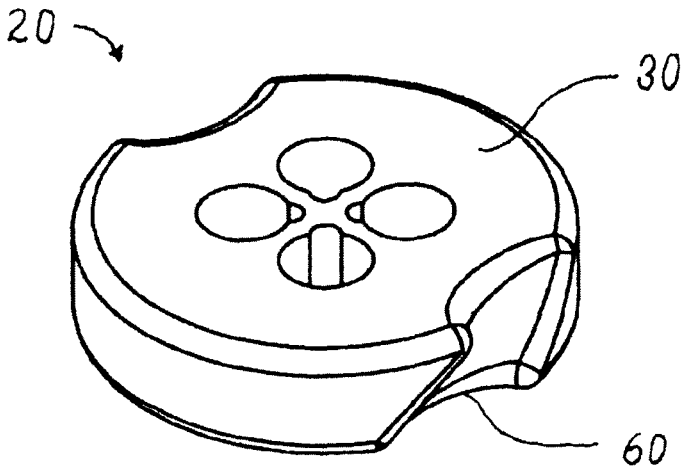
FIG. 6 is a perspective view of a preferred embodiment of the Optical Diffraction Alignment Lens of this invention.
Figure 7:
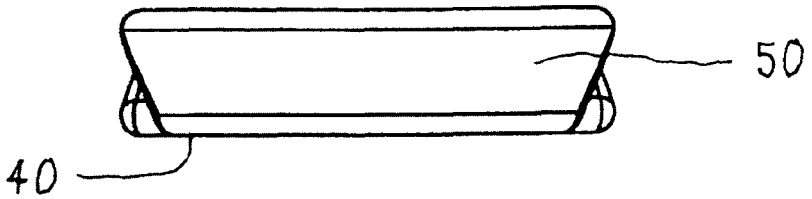
FIG. 7 is a top plan view thereof.
Figure 8:
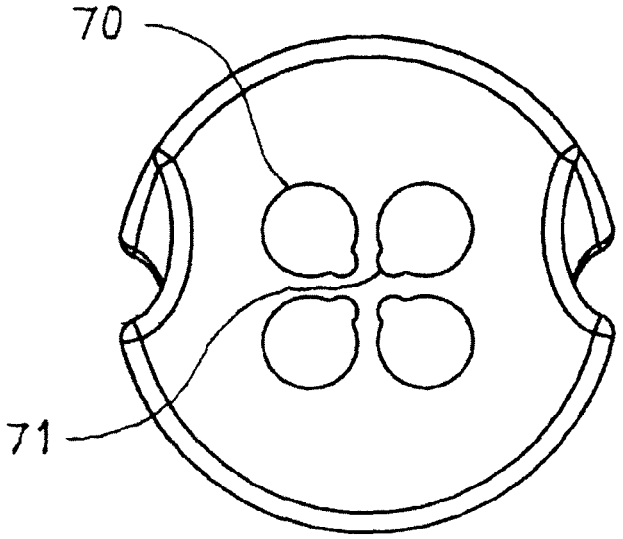
FIG. 8 is a front elevation view thereof.
Figure 9:
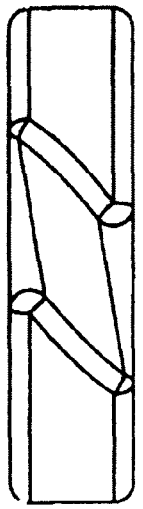
FIG. 9 is a right side elevation view thereof.

At full draw of the arrow, the Optical Diffraction Alignment Lens is positioned slightly in front of the eye of the archer. At the full draw position of the compound bow and arrow, the Optical Diffraction Alignment Lens presents to the eye of the archer a virtual aperture with well-defined optical edge boundaries (FIG. 5). The specific form or shape of the virtual aperture can be varied depending on the final dimensions and spacing of the initial four apertures. It can range from a small concave square to a precise virtual aperture with well-defined optical edge boundaries.

When an archer is preparing to shoot an arrow at a target and has an arrow at full draw position in a compound bow containing the split bowstring installed Optical Diffraction Alignment Lens of this invention, the aiming eye of the archer is centered in the line-of-sight established by the alignment of the tip of the fiber optic pin in the front sight installed on the compound bow with the center of the virtual aperture at the center point of the Optical Diffraction Alignment Lens. As the archer moves the aiming eye to the center of this line-of-sight, the archer will observe the light from the front sight fiber optic pin as it transmits through the Optical Diffraction Alignment Lens. The central structure of the Optical Diffraction Alignment Lens optically diffracts this transmitted light to form a perceived virtual aperture with well-defined edges centered on the tip of the front sight fiber optic pin. This perceived virtual aperture image is thereby presented to the eye of the archer for center point alignment and aiming of the arrow to be shot.

With the use of the Optical Diffraction Alignment Lens, the virtual aperture, as illustrated in FIG. 5, is visually perceived as a plus-sign image presented to the eye of the archer when at full draw of the arrow. This plus-sign image is perceived to be visually transparent to the eye of the archer rather than opaque. When the archer has achieved line-of sight alignment with the flight path of the arrow, the virtual aperture appears to be centered on the tip of the fiber optic point of light in the front sight with the on-target impact point visible in the center of the virtual aperture.

The width of the arms of the plus-sign image forming the virtual aperture visually presented to the eye of the archer is observed to be approximately twenty percent of the diameter of the tip of the fiber optic point of the front sight. Common fiber optic pin diameters used in archery front sights are 0.02, 0.03, and 0.04 inch.

These pin diameters optically form the arms of the plus-sign image with widths of approximately 0.004, 0.006, and 0.008 inch respectively. The visual acuity of the archer would strongly influence the choice for the size or diameter of the tip of the fiber optic pin and resultant plus-sign image arm dimensions viewable by the archer.

A front sight fiber optic pin of 0.04-inch diameter would result in the observed arms of the plus-sign image being approximately 0.008 inch in width. This image is perceived as a virtual aperture centered on the tip of the fiber optic pin. The front sight fiber optic pin at full draw of the arrow is approximately 24 to 30 inches in front of the eye of the archer. Good visual acuity would enable the archer to align the plus-sign image in the center of the tip of the fiber optic pin to within +/−0.002 inch.

Such a level of precision provided by the Optical Diffraction Alignment Lens in arrow alignment translates into an exact on target impact to within +/−0.1 inch of aim-point at release. No other arrow alignment and aiming device for compound bow archery application achieves the Optical Diffraction Alignment Lens level of aim and alignment precision.

By design and construction, the four aperture array within the Optical Diffraction Alignment Lens also functions as a four aperture pin-hole lens thereby achieving the level of corrective lens imaging often achieved by use of a clarifier lens. Similarly, by design and construction, the four aperture array within the Optical Diffraction Alignment Lens also functions as a four aperture pin-hole lens thereby achieving a level of increased visual acuity or optical resolution often achieved through the use of a front-sight magnifying-lens

3. Principle of Operation

The Optical Diffraction Alignment Lens images the light from the fiber optic pin in the front sight and presents the image formed to the eye of the archer. The monochromatic light from the tip of the fiber optic pin is optically diffracted as it passes through the symmetric planar array of multiple pin whole apertures in the center region of the Optical Diffraction Alignment Lens. As the single beam of light from the circular tip of the fiber optic pin passes through the center region of the Optical Diffraction Alignment Lens, it is split into the number of beams equal to the number of apertures in the Optical Diffraction Alignment Lens. For example, four beams are created in the preferred embodiment having four apertures. In the light path between the Optical Diffraction Alignment Lens and the eye of the archer, these four beams then optically combine with destructive interference and form a perceived virtual aperture image. At full draw of the arrow in the bow, by the design and placement of the Optical Diffraction Alignment Lens, this perceived image is precisely centered in the line-of-sight through the virtual aperture in the center of the Optical Diffraction Alignment Lens through the virtual aperture centered in the image of the tip of the front sight fiber optic pin on the compound bow to the intended impact point on target.

The Optical Diffraction Alignment Lens forms and presents to the eye of the archer, a virtual aperture image that can be centered by the archer with the arrow at full-draw, in the on-target line-of-sight thereby ensuring hitting the intended impact point on target. Repeatedly and accurately, the virtual aperture image in the Optical Diffraction Alignment Lens is produced in the same visual position relative to the nock end of the arrow. On a properly tuned bow, the virtual apertures provide the aiming eye of the archer with an unobstructed line-of-sight that visually enables the archer to verify that the flight path of the arrow is aimed and aligned to impact the target at the intended impact point on target.

The perceived image of the virtual aperture is created by optical diffraction of the light from the front sight fiber optic pin transmitted over the opaque interstitial structure of the apertures in the center of the Optical Diffraction Alignment Lens. The viewed virtual aperture image is symmetric when perfectly aligned. When slightly out of alignment, the virtual aperture image is asymmetric. The asymmetry of the plus sign image provides a precise and well-defined visible measure or indicator of both vertical and horizontal misalignment. As the misalignment continues to increase, the point is reached where none of the light from the front sight fiber optic pin is transmitted along the line-of-sight through the Optical Diffraction Alignment Lens, no diffraction pattern is formed, and the virtual aperture image disappears from the field of view of the archer.

The Optical Diffraction Alignment Lens provides visual verification of center point alignment to the eye of the archer by means of presenting to the eye of the archer a symmetric virtual aperture plus-sign image, which is formed when precise center point alignment of the line-of-sight of the archer with the flight path of the arrow occurs.

When the archer adjusts his point of view to align the virtual aperture plus-sign image on the center of the front fiber optic pin, the line-of-sight of the archer is centered in the flight path of the arrow. At the full draw position of the compound bow and arrow, the on-target line-of-sight of the archer is from the eye of the archer, through the center of the Optical Diffraction Alignment Lens, through the alignment point of the front sight, and to the intended impact point on target. In tuning the bow, the line-of-sight of the archer intersects the flight path of the arrow at the intended impact point on the target.

For an individual archer, trained with the use of arm hand positioning techniques employing kisser buttons and lock point positioning, neither the kisser button position nor the lock point positions are automatically center-point aligned. These positioning techniques provide an approximated center point alignment and may actually cause the archer to shoot from a non-center-point aligned position.

The Optical Diffraction Alignment Lens is automatically center-point aligned in the flight path of the arrow. For a trained archer, the use of manual positioning techniques may conflict with the proper use of the Optical Diffraction Alignment Lens in that the line-of-sight of the archer may not be properly centered in the plane of the flight path of the arrow.

The Optical Diffraction Alignment Lens provides a very precise front sight to Optical Diffraction Alignment Lens alignment mechanism when properly installed on a tuned compound bow with a front fiber optic pin sight. The precision of this compound bow sight alignment with the Optical Diffraction Alignment Lens maximizes the probability of the coincidence of the arrow impact point with the on target aim point.

I claim:

1. An optical diffraction alignment lens for attachment to a bow string of a compound archery bow and for use with a monochromatic front sight fiber optic pin that emits monochromatic light mounted onto the bow for aligning the bow at a target reflecting light, the lens comprising a disk with a side with opposing indentations for attachment to bow string strands, a front face, a rear face parallel to the front face and separated from the front face by a depth, a solid and opaque center, and a symmetrical planar array of four substantially-identical apertures that are equidistant from and equally spaced circumferentially about the solid and opaque center point, that are orthogonal to the front face and the rear face, and that extend from the front face to the rear face with a constant cross section, such that monochromatic light from the monochromatic front sight fiber optic pin and light reflected from the target form a symmetrical image containing a clear line of sight to the on-target impact point of the arrow along with a symmetrical pattern of monochromatic light visible to an archer drawing the bow when the bow is in precise alignment.

2. The lens of claim 1 wherein the apertures are substantially circular or merged circles in cross section and wherein the disk is substantially circular in cross section.

3. The lens of claim 2 wherein the lens has a diameter of about 0.3 to 0.7 inches, wherein the four apertures have nominal diameters of 0.05 to 0.2 inches, and wherein the interstitial space between adjacent apertures has a width of about 0.010 to 0.060 inch.

4. The lens of claim 1 wherein the apertures have a nominal diameter that is about equal to or less than the depth of the disk.

5. An archery bow and alignment assembly for aligning the bow at a target, the assembly comprising:

(a) a bow having an upper limb with an end, a lower limb with an end, and a riser with a grip and an arrow rest, the bow having a fully drawn position and a rest position;

(b) a bow string extending between the ends of the bow;

(c) a monochromatic front sight fiber optic pin mounted on the riser of the bow that emits monochromatic light; and (d) an optical diffraction alignment lens attached to the bow string, the lens comprising a disk with a side with opposing indentations for attachment to bow string strands, a front face, a rear face parallel to the front face and separated from the front face by a depth, a solid and opaque center, and a symmetrical planar array of four substantially-identical apertures that are equidistant from and equally spaced circumferentially about the solid and opaque center point, that are orthogonal to the front face and the rear face, and that extend from the front face to the rear face with a constant cross section, such that monochromatic light from the monochromatic front sight fiber optic pin and light reflected from the target form a symmetrical image containing a clear line of sight to the on-target impact point of the arrow along with a symmetrical pattern of monochromatic light visible to an archer drawing the bow when the bow is in precise alignment.

6. The assembly of claim 5 wherein the number of apertures in the lens is four.

7. The assembly of claim 6 wherein the apertures in the lens are substantially circular or merged circles in cross section.

8. The assembly of claim 7 wherein the lens is substantially circular in cross section.

9. The assembly of claim 8 wherein the lens has a diameter of about 0.3 to 0.7 inches, wherein the four apertures have nominal diameters of 0.05 to 0.2 inches, and wherein the interstitial space between adjacent apertures has a width of about 0.010 to 0.060 inch.

10. The assembly of claim 5 wherein the apertures of the lens have a nominal diameter that is about equal to or less than the depth of the disk.

11. A method for aligning a bow and arrow at a target, the method comprising:

(a) identifying a target;

(b) providing a bow and alignment assembly comprising:

(i) a bow having an upper limb with an end, a lower limb with an end, and a riser with a grip and an arrow rest, the bow having a fully drawn position and a rest position;

(ii) a bow string extending between the ends of the bow;

(iii) a monochromatic front sight fiber optic pin mounted on the riser of the bow that emits monochromatic light; and (iv) an optical diffraction alignment lens attached to the bow string, the lens comprising a disk with a side with opposing indentations for attachment to bow string strands, a front face, a rear face parallel to the front face and separated from the front face by a depth, a solid and opaque center, and a symmetrical planar array of four substantially-identical apertures that are equidistant from and equally spaced circumferentially about the solid and opaque center point, that are orthogonal to the front face and the rear face, and that extend from the front face to the rear face with a constant cross section, such that monochromatic light from the monochromatic front sight fiber optic pin and light reflected from the target form an image containing a clear line of sight to the on-target impact point of the arrow along with a symmetrical pattern of monochromatic light visible to an archer drawing the bow when the bow is in precise alignment;

(c) providing an arrow having a shaft and a nock;

(d) placing the nock of the arrow onto the bow string and resting the shaft of the arrow upon the arrow rest;

(e) drawing the bow;

(f) aligning the arrow so the image appears symmetrical; and (g) releasing the arrow.

12. The method of claim 11 wherein the number of apertures in the lens is four.

13. The method of claim 12 wherein the apertures in the lens are substantially circular or merged circles in cross section.

14. The method of claim 13 wherein the lens is substantially circular in cross section.

15. The method of claim 14 wherein the lens has a diameter of about 0.3 to 0.7 inches, wherein the four apertures have nominal diameters of 0.05 to 0.2 inches, and wherein the interstitial space between adjacent apertures has a width of about 0.010 to 0.060 inch.

16. The method of claim 11 wherein the apertures of the lens have a nominal diameter that is about equal to or less than the depth of the disk.

* * * * *